United States Patent [19]

Scherzer

[11] Patent Number: 4,747,935

[45] Date of Patent: May 31, 1988

[54] PROCESS FOR THE CATALYTIC CRACKING OF FEEDSTOCKS CONTAINING NITROGEN

[75] Inventor: Julius Scherzer, Anaheim, Calif.

[73] Assignee: Union Oil Company of California, Los Angeles, Calif.

[21] Appl. No.: 844,463

[22] Filed: Mar. 26, 1986

[51] Int. Cl.[4] ..... C10G 11/18; C10G 17/095

[52] U.S. Cl. ..... 208/120; 208/113; 208/114; 208/121; 208/254 R; 208/265; 208/266; 208/279

[58] Field of Search ..... 208/120, 254 R, 113, 208/90, 114, 121, 265, 266, 279; 585/820, 823; 502/515

[56] References Cited

U.S. PATENT DOCUMENTS

| | | | |
|---|---|---|---|
| 2,352,236 | 6/1944 | Thomas | 208/90 |
| 2,800,427 | 7/1957 | Junk, Jr. et al. | 208/254 R |
| 2,925,375 | 2/1960 | Fleck et al. | 208/254 R |
| 2,925,381 | 2/1960 | Fleck et al. | 208/254 |
| 2,962,435 | 11/1960 | Fleck et al. | 208/119 |
| 3,886,060 | 5/1975 | Owen | 208/120 |
| 3,925,195 | 12/1975 | Scherzer et al. | 208/120 |
| 4,090,948 | 5/1978 | Schwarzenbeck | 208/120 |
| 4,125,457 | 11/1978 | Brennan et al. | 208/254 R |
| 4,137,154 | 1/1979 | Audeh | 208/254 R |
| 4,147,613 | 4/1979 | Gladrow | 208/120 |
| 4,253,939 | 3/1981 | Mooi | 208/113 |
| 4,289,605 | 9/1981 | Bartholic | 208/113 |
| 4,390,416 | 6/1983 | Ritter et al. | 208/113 |
| 4,428,825 | 1/1984 | Ward et al. | 208/109 |
| 4,434,147 | 2/1984 | Dimpfl et al. | 208/254 R |
| 4,465,588 | 8/1984 | Occelli et al. | 208/120 |
| 4,477,336 | 10/1984 | Scherzer | 502/67 |
| 4,519,897 | 5/1985 | De Jong | 208/120 |
| 4,552,648 | 11/1985 | Rosinski et al. | 208/120 |
| 4,584,091 | 4/1986 | Pine | 208/120 |
| 4,615,996 | 10/1986 | Occelli | 502/65 |
| 4,650,564 | 3/1987 | Occelli et al. | 208/113 |

FOREIGN PATENT DOCUMENTS

| | | | |
|---|---|---|---|
| 2116062 | 9/1983 | United Kingdom | 208/120 |
| 2145345 | 3/1985 | United Kingdom | 208/120 |

OTHER PUBLICATIONS

C. Marcilly and J. P. Franck, "Use of Zeolite Containing Catalysts in Hydrocracking," *Catalysis by Zeolites*, Elsevier Scientific Publishing Company, Amsterdam, pp. 93–104, (1980).

J. W. Scott and A. G. Bridge, "The Continuing Development of Hydrocracking," *Advances in Chemistry Series* 103, American Chemical Society, Washington, D.C., pp. 113–129, (1971).

G. A. Mills, E. R. Boedeker and A. G. Oblad, "Chemical Characterization of Catalysts. I. Poisoning of Cracking Catalysts by Nitrogen Compounds and Potassium Ion, *Journal of American Chemical Society*, vol. 72, pp. 1554–1560, (1950).

*Primary Examiner*—Helen M. S. Sneed
*Assistant Examiner*—Anthony McFarlane
*Attorney, Agent, or Firm*—Finkle, Yale S.; Gregory F. Wirzbicki; Dean Sandford

[57] ABSTRACT

Hydrocarbon feedstocks containing relatively high levels of nitrogen contaminants are converted by catalytic cracking to products of lower average molecular weight by contacting the feedstock with a mixture of a cracking catalyst and separate particles of a nitrogen scavenger comprising microporous solids selected from the group consisting of acid clays; hydrogen or ammonium exchanged mordenite, clinoptilolite, chabazite and erionite; mineral acids or mineral acid precursors supported on an inorganic, refractory oxide; and Catapal alumina.

33 Claims, No Drawings

PROCESS FOR THE CATALYTIC CRACKING OF FEEDSTOCKS CONTAINING NITROGEN

BACKGROUND OF THE INVENTION

This invention relates to a catalytic cracking process and is particularly concerned with the cracking of feedstocks containing substantial quantities of nitrogen-containing compounds.

Fluidized catalytic cracking (FCC) units are used in the petroleum industry to convert high boiling hydrocarbon feedstocks to more valuable hydrocarbon products, such as gasoline, having a lower average molecular weight and a lower average boiling point than the feedstocks from which they were derived. The conversion is normally accomplished by contacting the hydrocarbon feedstock with a moving bed of catalyst particles at temperatures ranging between about 800° F. and about 1100° F. The most typical hydrocarbon feedstock treated in FCC units comprises a heavy gas oil, but on occasions such feedstocks as light gas oils or atmospheric gas oils, naphthas, reduced crudes and even whole crudes are subjected to catalytic cracking to yield low boiling hydrocarbon products.

Catalytic cracking in FCC units is generally accomplished by a cyclic process involving separate zones for catalytic reaction, steam stripping, and catalyst regeneration. The hydrocarbon feedstock is blended with an appropriate amount of catalyst particles to form a mixture that is then passed through a catalytic reactor, normally referred to as a riser, wherein the mixture is subjected to a temperature between about 800° F. and about 1100° F. in order to convert the feedstock into gaseous, lower boiling hydrocarbons. After these gaseous, lower boiling hydrocarbons are separated from the catalyst in a suitable separator, such as a cyclone separator, the catalyst, now deactivated by coke deposited upon its surfaces, is passed to a stripper. Here the deactivated catalyst is contacted with steam to remove entrained hydrocarbons that are then combined with vapors exiting the cyclone separator to form a mixture that is subsequently passed downstream to other facilities for further treatment. The coke-containing catalyst particles recovered from the stripper are introduced into a regenerator, normally a fluidized bed regenerator, where the catalyst is reactivated by combusting the coke in the presence of an oxygen-containing gas, such as air, at a temperature which normally ranges between about 1000° F. and about 1500° F. The cyclic process is then completed by blending the reactivated catalyst particles with the feedstock entering the riser or reaction zone of the FCC unit.

It is well known that catalytic cracking feedstocks which contain high levels of nitrogen have a deleterious effect on cracking catalysts. The nitrogen is typically present in the form of basic or neutral organic compounds, primarily aromatic compounds containing nitrogen heteroatoms such as pyridines, quinolines and indoles, which are strongly sorbed on the acidic sites of the cracking catalyst. The nitrogen compounds react or otherwise interact with the acidic sites so as to decrease the activity of the catalyst. This deactivation results in decreased conversions and gasoline production. Levels of nitrogen in the feedstock as small as 0.01 weight percent, calculated as the element, can result in some decrease in activity of the catalyst; however, significant deactivation is not normally encountered unless the concentration of nitrogen in the feedstock increases to about 0.08 weight percent or above. Nitrogen poisoning of cracking catalyst is quite severe when the feedstock is a synthetic oil derived from carbonaceous solids such as oil shale, coal, tar sands and the like. Such synthetic oils tend to have relatively high concentrations of nitrogen, sometimes ranging as high as 5.0 weight percent, calculated as the element.

In order to avoid substantial deactivation of cracking catalysts by nitrogen compounds in feedstocks containing high levels of nitrogen, it has been standard practice to treat such feedstocks to reduce the concentration of nitrogen compounds prior to subjecting the feedstocks to catalytic cracking. Techniques employed in the past for removing the nitrogen compounds from the feedstocks include (1) adsorbing the compounds on solid material such as silica, alumina or various grades of clay, (2) treating the feedstock with mineral acids to form water-soluble salts of the basic nitrogen compounds, which salts can readily be removed from the feedstock, and (3) treating the feedstock in the presence of added hydrogen with a hydrogenation catalyst. Of these three techniques, the latter one, hydroprocessing, is the one most frequently used. However, in order to remove substantial quantities of residual nitrogen, hydrogenation pressures up to 5000 p.s.i.g. are typically required. Installation of equipment to carry out such a high pressure process requires a substantial capital investment. The other two techniques also have disadvantages in that they too require the installation of additional equipment and are not always able to remove as much nitrogen as desired.

Accordingly, it is one of the objects of the present invention to provide a fluid catalytic cracking process for treating feedstocks that contain relatively high concentrations of nitrogen constituents while maintaining the activity of the catalyst at a reasonable level. It is another object of the invention to provide such a process without the necessity of first treating the feedstock to remove substantially all or a portion of the nitrogen-containing compounds. These and other objects of the invention will become more apparent in view of the following description of the invention.

SUMMARY OF THE INVENTION

In accordance with the invention, it has now been found that the deleterious effects of nitrogen constituents on the activity and selectivity of a catalytic cracking catalyst comprising a molecular sieve having cracking activity dispersed in a matrix or binder can be substantially avoided by mixing the catalyst with separate particles of a nitrogen scavenger selected from the group consisting of acid clays such as montmorillonite, kaolin and halloysite; hydrogen or ammonium exchanged mordenite, clinoptilolite, chabazite and erionite; supported mineral acids such as phosphoric acid supported on alumina, silica or clay; and Catapal alumina. It has been found that hydrocarbon feedstocks containing substantial concentrations of nitrogen compounds can be effectively subjected to catalytic cracking without prior treatment to remove the nitrogen compounds by replacing between about 5 and about 60 weight percent of the normal catalyst inventory in an FCC unit with a nitrogen scavenger as described above.

In general, the feestock to the process of the invention will contain greater than about 0.08 weight percent total nitrogen, calculated as the element, typically between about 0.10 and about 5.0 weight percent depending on whether the feedstock is a petroleum based feedstock or a synthetic oil derived from oil shale, coal or similar carbonaceous solids. Normally, the feed is a gas oil derived from petroleum and containing between about 0.10 and about 0.50 weight percent total nitrogen, calculated as the element.

The process of the invention has many advantages over other catalytic cracking processes in that it allows for the processing of feedstocks containing relatively high concentrations of nitrogen without first having to install equipment to treat the feedstock prior to subjecting it to catalytic cracking. Moreover, the use of an inexpensive nitrogen scavenger in lieu of a portion of the more expensive cracking catalyst decreases the cost of the catalyst.

DETAILED DESCRIPTION OF THE INVENTION

In accordance with this invention, a fluidized catalytic cracking (FCC) process, or other cyclic catalytic cracking process, in which a hydrocarbon feedstock containing nitrogen compounds is refined to produce low-boiling hydrocarbon products by passing the feedstock in contact with a cracking catalyst through a catalytic cracking reaction zone in the substantial absence of added molecular hydrogen is improved by introducing a nitrogen sorbent or scavenger into the cyclic process to preferentially sorb nitrogen components from the feed and thereby prevent them from deactivating the cracking catalyst. In general, any molecular sieve possessing cracking activity at temperatures above 750° F. may be used as the acidic component of the cracking catalyst. The term "molecular sieve" as used herein refers to any material capable of separating atoms or molecules based on their respective dimensions. Molecular sieves suitable for use as a component of the cracking catalyst include pillared clays, delaminated clays, and crystalline aluminosilicates. Normally, it is preferred to use a cracking catalyst which contains a crystalline aluminosilicate. Examples of such aluminosilicates include Y zeolites, ultrastable Y zeolites, X zeolites, zeolite beta, zeolite L, offretite, mordenite, faujasite, and zeolite omega. The preferred crystalline aluminosilicates for use in the cracking catalyst are X and Y zeolites with Y zeolites being the most preferred. Such zeolites have a pore size of about 8.1 Angstroms. The term "pore size" as used herein refers to the diameter of the largest molecule that can be sorbed by the particular molecular sieve in question. The measurement of such diameters and pore sizes is discussed more fully in Chapter 8 of the book entitled "Zeolite Molecular Sieves" written by D. W. Breck and published by John Wiley & Sons in 1974, the disclosure of which book is hereby incorporated by reference in its entirety.

U.S. Pat. No. 3,130,007, the disclosure of which is hereby incorporated by reference in its entirety, describes Y-type zeolites having an overall silica-to-alumina mole ratio between about 3.0 and about 6.0 with a typical Y zeolite having an overall silica-to-alumina mole ratio of about 5.0. It is also known that Y-type zeolites can be produced, normally by dealumination, having an overall silica-to-alumina mole ratio above about 6.0. Thus, for purposes of this invention, a Y zeolite is one having the characteristic crystal structure of a Y zeolite, as indicated by the essential X-ray powder diffraction pattern of Y zeolite, and an overall silica-to-alumina mole ratio above 3.0, and includes Y-type zeolites having an overall silica-to-alumina mole ratio above about 6.0.

The stability and/or acidity of a zeolite used as a component of the cracking catalyst may be increased by exchanging the zeolite with ammonium ions, polyvalent metal cations, such as rare earth-containing cations, magnesium cations or calcium cations, or a combination of ammonium ions and polyvalent metal cations, thereby lowering the sodium content until it has less than about 0.8 weight percent, preferably less than about 0.5 weight percent and most preferably less than about 0.3 weight percent, calculated as $Na_2O$. Methods of carrying out the ion exchange are well known in the art.

The zeolite or other molecular sieve component of the catalyst is combined with a porous, inorganic refractory oxide matrix or binder to form a finished catalyst prior to use. The refractory oxide component in the finished catalyst may be silica-alumina, silica, alumina, natural or synthetic clays, pillared or delaminated clays, mixtures of one or more of these components and the like. Preferably, the inorganic refractory oxide matrix will comprise a mixture of silica-alumina and a relatively nonporous, nonpillared and non-delaminated clay such as kaolin, hectorite, sepiolite and attapulgite. A preferred finished catalyst will typically contain between about 5 weight percent and about 40 weight percent zeolite or other molecular sieve and greater than about 20 weight percent inorganic, refractory oxide. In general, the finished catalyst will contain between about 10 and about 35 weight percent zeolite or other molecular sieve, between about 10 and about 30 weight percent inorganic, refractory oxide, and between about 30 and about 65 weight percent nonpillared and nondelaminated clay.

The crystalline aluminosilicate or other molecular sieve component of the cracking catalyst may be combined with the porous, inorganic refractory oxide component or a precursor thereof by techniques including mixing, mulling, blending or homogenization. Examples of precursors that may be used include alumina, alumina sols, silica sols, zirconia, alumina hydrogels, polyoxycations of aluminum and zirconium, and peptized alumina. In a preferred method of preparing the cracking catalyst, the zeolite is combined with an aluminoaluminosilicate gel or sol, a clay and/or other inorganic refractory oxide component, and the resultant mixture is spray dried to produce finished catalyst particles normally ranging in diameter between about 40 and about 80 microns. If desired, however, the zeolite or other molecular sieve may be mulled or otherwise mixed with the refractory oxide component or precursor thereof, extruded and then ground into the desired particles size range. Normally, the finished catalyst will have an average bulk density between about 0.30 and about 1.0 gram per cubic centimeter and a pore volume between about 0.10 and about 0.90 cubic centimeter per gram.

Cracking catalysts prepared as described above and containing zeolites or other molecular sieves normally become poisoned and severely deactivated for cracking when the nitrogen concentration of the hydrocarbon feedstock is greater than about 0.08 weight percent, calculated as the element. It has now been found that such deleterious effects on the cracking catalyst can be substantially avoided by replacing a portion of the cracking catalyst inventory in the FCC unit with separate particles of a nitrogen scavenger comprising a microporous solid selected from the group consisting of acid clays; hydrogen or ammonium exchanged mordenite, clinoptilolite, chabazite and erionite; supported mineral acids; and Catapal alumina. These solids are strongly acidic and it is believed that the basic nitrogen compounds in the hydrocarbon feedstock preferentially sorb on the surface of the solids, thereby preventing such compounds from reacting with the acid cracking sites in the separate catalyst particles. The result is that the activity and selectivity of the catalyst are maintained at a relatively high level or increased even though the feedstock may be relatively rich in nitrogen components.

The acid clays suitable for use as the nitrogen scavenger include kaolin, halloysite, sepiolite, vermiculite and the various species of naturally occurring and synthetic smectite clays. Examples of smectite clays that may be used include montmorillonite, beidellite, nontronite, hectorite and saponite. Normally, it is preferred to wash the clays with mineral acid prior to their use as the nitrogen scavenger. Microporous particles of the acid clay can be prepared by grinding the clay to a particle size of less than about 1.0 micron, slurrying the ground clay with water and subjecting the resultant slurry to spray drying to produce microporous particles ranging in diameter between about 20 and about 150 microns, preferably between about 40 and 80 about microns. If desired, a binder such as Catapal alumina may be added to the slurry prior to spray drying. If a binder is added, it will typically be present in the finished microporous particles in an amount ranging between about 3 and about 30 weight percent, preferably between about 10 and about 20 weight percent.

The nitrogen scavenger used in the process of the invention may also be a hydrogen or ammonium exchanged mordenite, clinoptilolite, chabazite or erionite. Normally, the above zeolites when used as the scavenger will contain less than 3 weight percent metal cations based on the weight of the corresponding metal oxide, preferably less than about 1 weight percent. The hydrogen exchanged zeolite is typically prepared by subjecting the zeolite to repetitive treatments for short periods of time with dilute mineral acids such as hydrochloric acid, nitric acid and sulfuric acid. The ammonium exchanged zeolite is prepared by ion exchanging the zeolite with ammonium ions in accordance with procedures known in the art. The zeolite may be used alone or in combination with a binder or matrix such as Catapal alumina or kaolin clay.

Also suitable for use as the nitrogen scavenger are minerals acids, or mineral acid precursors, supported on an inorganic, refractory oxide. Examples of mineral acids that may be used include phosphoric acid, sulfuric acid, boric acid, with phosphoric acid being the most preferred. Although any inorganic, refractory oxide may be used as the support for the mineral acid, alumina, silica, clays, and silica-alumina are typically preferred with silica being the most preferred support. A mineral acid precursor may be used in lieu of a mineral acid to form the nitrogen scavenger. As used herein the term "mineral acid precursor" refers to a compound which will form a mineral acid when subjected to conditions in the riser of a FCC unit. Examples of suitable phosphoric acid precursors include diammonium and monoammonium phosphate. The supported acid is typically prepared by mixing particles of the desired support with a solution of the mineral acid or precursor thereof such that the support is impregnated to the point of incipient wetness. The impregnated support is then dried and calcined. The particle size of the impregnated support will typically range between about 20 and 150 microns in diameter, preferably between about 40 and 80 microns.

Catapal alumina may also be used as the nitrogen scavenger. Catapal alumina is the same or similar to Ziegler alumina which has been characterized in U.S. Pat. Nos. 3,852,190 and 4,012,313 as a byproduct from Ziegler higher alcohol synthesis reaction as described in U.S. Pat. No. 2,892,858. These three patents are hereby incorporated by reference in their entireties. Catapal alumina is presently available from the Conoco Chemical Division of DuPont Chemical Company and is an extremely high purity alpha-alumina monohydrate (boehmite) which, after calcination at a high temperature, has been shown to yield a high purity gamma-alumina.

As mentioned previously, the nitrogen scavenger is microporous and therefore has a relatively high surface area, typically ranging between about 50 and about 700 square meters per gram, preferably between about 125 and about 500 square meters per gram. The total pore volume is typically in the range between about 0.15 and about 0.70 cubic centimeter per gram, preferably between about 0.20 and about 0.50 cubic centimeter per gram. The particle size of the nitrogen scavenger can vary over a wide range, but is preferably approximately the same size as the cracking catalyst, typically between about 20 and about 100 microns in diameter, preferably between about 40 and about 80 microns. The amount of cracking catalyst and nitrogen scavenger present in the FCC unit will be such that the weight ratio of the cracking catalyst to the nitrogen scavenger normally ranges between about 19:1 and about 1:1, preferably between about 9:1 and about 3:1.

It has been found that, when a nitrogen scavenger as described above is used in combination with a cracking catalyst in an FCC unit, the cracking catalyst becomes more effective for cracking feedstocks containing relatively high concentrations of nitrogen, typically concentrations greater than about 0.08 weight percent total nitrogen, calculated as the element. The process of the invention is typially used to treat petroleum derived feedstocks having total nitrogen concentrations ranging between about 0.10 and about 2.0 weight percent, typically between about 0.10 and about 0.50 weight percent, calculated as the element. The process of the invention can also be used to crack feedstocks derived from carbonaceous solids such as coal, oil shale, and tar sands, which feedstocks normally contain nitrogen in total concentrations ranging between about 1.0 and about 5.0 weight percent, typically between about 1.5 and about 3.0 weight percent, calculated as the element.

In general, it is preferred that the feedstock to the process of the invention not contain significant concentrations of metals, such as nickel, vanadium, iron, copper and the like. Normally, the concentration of metals in the feedstock is such that the following relationship exists:

$$10[Ni]+[V]+[Fe]<10 \quad (1)$$

where [Ni], [V], and [Fe] are the concentrations of nickel, vanadium and iron, respectively, in parts per million by weight. Preferably the sum of the values on the left hand side of equation (1) above will be less than about 8.0, most preferably less than about 5.0. Also, the concentrations of nickel and vanadium in the feedstock will typically be such that the concentration of nickel in ppmw plus ¼ the concentration of vanadium in ppmw is less than about 0.50 ppmw, preferably less than about 0.40 ppmw. In general, the individual concentrations of nickel, vanadium, and copper in the feedstock will be less than about 1.0 ppmw.

The hydrocarbon feedstocks that can be effectively treated using the process of the invention include any hydrocarbon feedstock normally used in cyclic catalytic cracking processes to produce low boiling hydrocarbons which also contains relatively high concentrations of nitogen. Examples of such feedstocks are vacuum gas oils, atmospheric gas oils, naphtha and the like. Normally, the feed material wil have an API gravity in the range between about 18° and about 28°, preferably between about 20° and about 25°. A typical feedstock will contain more than about 70 volume percent liquids boiling above about 650° F. Suitable feedstocks not only include petroleum derived fractions but also hydrocarbon oils derived from coal, oil shale tar sands and similar hydrocarbon-containing solids. Although shale oils are known to contain nitrogen in a highly refractory form, the process of the invention has been found to be particlarly effective in treating shale oils, which normally have concentrations of total nitrogen ranging between about 1.0 and about 5.0 weight percent, calculated as the element.

The nature and objects of the invention are further illustrated by the following examples, which are provided for illustrative purposes only and not to limit the invention as defined by the claims. Examples 1 through 3 describe the preparation of 3 catalytic cracking catalysts. Example 4 describes the preparation of a microporous kaolin nitrogen scavenger. Examples 5 through 8 illustrate that microporous kaolin and Catapal alumina are effective nitrogen scavengers.

EXAMPLE 1 an experimental cracking catalyst is prepared by mixing 700 grams (dry basis) of a low soda, rare earth exchanged Y zeolite with 3300 grams of a colloidal silica sol containing 525 grams of silica. The mixture is stirred in an industrial blender for 2 to 3 minutes and the resultant slurry is placed in a Cowles mixer along with 1750 grams (dry basis) of kaolin. The slurry is stirred in the Cowles mixer for 10 minutes at moderate speed. Aluminum chlorhydrol powder, containing 525 grams alumina, is added gradually to the mixture while stirring. Water is then added to obtain a 35 weight percent solids slurry and the mixture is stirred again for 10 minutes at high speed. The slurry is spray dried and the resultant product is screened to produce particles between 40 and 140 microns in diameter. These particles are calcined at 595° C. for 2 hours. The formulation and chemical composition of the catalyst are set forth below in Table 1.

EXAMPLE 2

An experimental catalyst is prepared by the procedure described in Example 1 except 1050 grams (dry basis) of the rare earth exchanged Y zeolite and 1400 grams (dry basis) of kaolin clay are used. The formulation and chemical composition of this catalyst are also set forth in Table 1.

EXAMPLE 3

Another experimental catalyst is prepared by the procedure described in Example 1 except 1400 grams (dry basis) of the rare earth exchanged Y zeolite and 1050 grams (dry basis) of kaolin are used. The formulation and chemical composition of this catalyst are also set forth in Table 1.

TABLE 1

| | Example 1 Catalyst | Example 2 Catalyst | Example 3 Catalyst |
|---|---|---|---|
| Catalyst Formulation | | | |
| Rare Earth Exchanged Zeolite (wt %) | 20 | 30 | 40 |
| Silica (wt %) | 15 | 15 | 15 |
| Alumina (wt %) | 15 | 15 | 15 |
| Kaolin (wt %) | 50 | 40 | 30 |
| Chemical Composition | | | |
| $SiO_2$ (wt %) | 54.2 | 55.8 | 57.0 |
| $Al_2O_3$ (wt %) | 40.9 | 39.8 | 36.0 |
| $Na_2O$ (wt %) | 0.20 | 0.20 | 0.17 |
| $RE_2O_3$ (wt %) | 2.75 | 4.62 | 5.85 |

EXAMPLE 4

A nitrogen scavenger comprising mircoporous kaolin particles is prepared by mixing a fine particle kaolin clay obtained from the Huber Company in a Cowles blender with sufficient water to produce a slurry of about 40 weight percent solids. The slurry is spray dried and the resultant product is screened to produce particles ranging in diameter between 40 and 100 microns.

EXAMPLE 5

The microporous kaolin particles produced in Example 4 are tested for their effectiveness as a nitrogen scavenger during the catalytic cracking of nitrogen-containing feedstocks as follows. A 50 gram sample of the catalyst prepared in Example 1 is deactivated for testing by treatment in 100 percent flowing steam at 1450° F. for 5 hours. The deactivated catalyst is then evaluated for cracking activity by the standard microactivity test (MAT) method using two feedstocks. The first feedstock has an API gravity of 22.8° and contains 0.48 weight percent total nitrogen, calculated as the element, and 0.16 weight percent basic nitrogen, calculated as the element. The first feedstock further contains 3 ppmw iron, less than 0.5 ppmw nickel and less than 0.5 ppmw vanadium. The second feedstock has an API gravity of 24.4° and contains 0.74 weight percent total nitrogen, calculated as the element and 0.37 weight percent basic nitrogen, calculated as the element. The second feedstock also contains 2 ppmw iron, less than 0.5 ppmw nickel and less than 0.5 ppmw vanadium. The MAT test for each feedstock is carried out at atmospheric pressure and at a temperature of 950° F. utilizing a weight hourly space velocity of 14.5 and a catalyst-to-oil ratio of 3.5. The results of these tests are set forth below in Table 2.

One hundred grams of the catalyst prepared in Example 3 is physically mixed with 100 grams of the microporous kaolin particles produced in Example 4. A 50 gram sample of this mixture is deactivated for testing by treatment in 100 percent flowing steam at 1450° F. for 5 hours. Portions of the steam treated sample are then evaluated for cracking activity by the MAT test method as described above using both of the above-described feedstocks. The results of these tests are also set forth in Table 2 and compared to the results obtained using the catalyst of Example 1 without the kaolin additive.

TABLE 2

| | Example 1 Catalyst | Example 1 Catalyst | 50 wt % Example 3 Catalyst + 50 wt % kaolin | |
|---|---|---|---|---|
| | Run No. 1 | Run No. 2 | Run No. 1 | Run No. 2 |
| Nitrogen content of feed (wt %) | 0.48 | 0.74 | 0.48 | 0.74 |
| Zeolite content (wt %) | 20 | 20 | 20 | 20 |
| Conversion (vol %) | 69 | 58 | 73 | 64 |
| Gasoline (vol %) | 53.2 | 43.1 | 54.9 | 47.4 |
| LCO (vol %) | 20.7 | 26.0 | 19.0 | 24.9 |
| Coke (vol %) | 4.7 | 4.1 | 5.1 | 4.9 |
| Hydrogen (scf/b) | 60 | 52 | 74 | 72 |

Since the catalyst prepared in Example 3 contains 40 weight percent zeolite, a 1-to-1 blend of the catalyst with the kaolin particles results in a mixture that has a zeolite content of 20 weight percent, the same amount of zeolite found in the catalyst prepared in Example 1. By comparing the MAT test results obtained with the mixture of the Example 3 catalyst and kaolin to those obtained with the Example 1 catalyst, the dilution effect of the kaolin is eliminated. A comparison of the data for runs 1 and 2 in Table 2 indicate that as the nitrogen content of the feed increases, the conversion and gasoline production decrease. For a feedstock having a constant concentration of nitrogen, replacing a portion of the catalyst with kaolin while maintaining constant the total zeolite content of the mixture, results in increased conversions and gasoline production. When utilizing the feedstock containing 0.48 weight percent total nitrogen, the presence of the kaolin nitrogen scavenger increased conversion from 69 to 73 volume percent and gasoline production from 53.2 to 54.9 volume percent. When the feedstock containing the higher concentration of nitrogen (0.74 weight percent) was used, the conversion obtained increased from 58 to 64 volume percent while the gasoline production rose from 43.1 to 47.4 volume percent. Obviously, the kaolin scavenger has a greater beneficial effect on conversion and gasoline production as the nitrogen content of the feedstock increases.

EXAMPLE 6

A 50 gram sample of the catalyst prepared in Example 2 is deactivated for testing by treatment in 100 percent flowing steam at 1500° F. for 5 hours. The deactivated catalyst sample is then evaluated for cracking activity using the MAT method and a third feedstock having an API gravity of 22.0° and containing 0.30 weight percent total nitrogen, calculated as the element, and 0.094 weight percent basic nitrogen, calculated as the element. The MAT test is carried out at atmospheric pressure at a temperature of 950° F. utilizing a weight hourly space velocity of 14.5 and a catalyst-to-oil ratio of 3.5. The results of the test are set forth below in Table 3.

One hundred grams of the catalyst prepared in Example 3 is physically combined with 50 grams of the kaolin particles produced in Example 4. A 50 gram sample of this mixture is deactivated for testing by treatment in 100 percent flowing steam at 1500° F. for 5 hours. A portion of the steam tested sample is then evaluated for cracking activity using the MAT method and the same feedstock used to evaluate the activity of the Example 2 catalyst. The results of this test are also set forth in Table 3.

TABLE 3

| | Example 2 Catalyst | 66.7 wt % Example 3 Catalyst + 33.3 wt % kaolin |
|---|---|---|
| Nitrogen content of feed (wt %) | 0.30 | 0.30 |
| Zeolite content (wt %) | 30 | 26.6 |
| Conversion (vol %) | 80 | 80 |
| Gasoline (vol %) | 61.8 | 60.7 |
| LCO (vol %) | 15.3 | 15.3 |
| Coke (vol %) | 5.3 | 5.9 |
| Hydrogen (scf/b) | 33 | 65 |

The data in Table 3 indicate that, although the zeolite content of the mixture of the Example 3 catalyst and kaolin is less than the zeolite content of the Example 2 catalyst, the catalytic performance of the mixture is similar to that of the Example 2 catalyst when the feedstock contains 0.30 weight percent nitrogen. It is theorized that the better performance of the mixture is due to the preferential sorption of nitrogen compounds on the kaolin which in turn results in partial protection of the acid sites in the zeolite.

EXAMPLE 7

Catapal alumina is tested for its effectiveness as a nitrogen scavenger in a manner similar to that used for testing kaolin in Example 5. A mixture of 100 grams of the catalyst prepared in Example 3 and 100 grams of Catapal alumina is prepared and tested for activity as described in Example 5. The results of these tests are set forth in Table 4 below and compared to the results obtained in Example 5 using the Example 1 catalyst without an added nitrogen scavenger.

TABLE 4

| | Example 1 Catalyst | Example 1 Catalyst | 50 wt % Example 3 Catalyst + 50 wt % Catapal alumina | |
|---|---|---|---|---|
| | Run No. 1 | Run No. 2 | Run No. 1 | Run No. 2 |
| Nitrogen content of feed (wt %) | 0.48 | 0.74 | 0.48 | 0.74 |
| Zeolite content (wt %) | 20 | 20 | 20 | 20 |
| Conversion (vol %) | 69 | 58 | 79 | 71 |
| Gasoline (vol %) | 53.2 | 43.1 | 59.4 | 51.6 |
| LCO (vol %) | 20.7 | 26.0 | 15.7 | 21.0 |
| Coke (vol %) | 4.7 | 4.1 | 7.3 | 7.0 |
| Hydrogen (scf/b) | 60 | 52 | 127 | 137 |

The data in Table 4 show that at a constant zeolite content of 20 weight percent, the presence of separate particles of Catapal alumina significantally increases the conversion and gasoline production obtained from cracking the nitrogen containing feedstocks. For the feedstock containing 0.48 weight percent nitrogen, the conversion increased from 69 to 79 volume percent and the gasoline production rose from 53.2 to 59.4 volume percent. The conversion obtained with the feedstock containing the higher concentration of nitrogen (0.74 weight percent) increased from 58 to 71 volume percent while the gasoline production rose from 43.1 to 51.6 volume percent. A drawback of use of Catapal alumina, however, appears to be a greater increase in coke and hydrogen production.

EXAMPLE 8

A mixture containing 33.3 weight percent Catapal alumina and 66.7 weight percent of the Example 3 catalyst is prepared and deactivated for testing by treatment in 100 percent flowing steam at 1450° F. for 5 hours. A portion of the catalyst prepared in Example 2 is also deactivated for testing by steam treatment under the same conditions. Portions of both the steam treated mixture and the steam treated Example 2 catalyst are then evaluated for cracking activity by the MAT test method using both of the feedstocks described in Example 5. The MAT tests are carried out at atmospheric pressure and at a temperature of 950° F. utilizing a weight hourly space velocity of 14.5 and a catalyst-to-oil ratio of 3.5. The results of the tests are set forth in Table 5 below.

TABLE 5

| | Example 2 Catalyst | Example 2 Catalyst | 66.7 wt % Example 3 Catalyst + 33.3 wt % Catapal alumina | |
|---|---|---|---|---|
| | Run No. 1 | Run No. 2 | Run No. 1 | Run No. 2 |
| Nitrogen content of feed (wt %) | 0.48 | 0.74 | 0.48 | 0.74 |
| Zeolite content (wt %) | 30 | 30 | 26.6 | 26.6 |
| Conversion (vol %) | 82 | 75 | 84 | 78 |
| Gasoline (vol %) | 56.8 | 53.1 | 58.8 | 54.6 |
| LCO (vol %) | 13.9 | 18.6 | 12.8 | 16.8 |
| Coke (vol %) | 8.1 | 7.2 | 8.9 | 8.2 |
| Hydrogen (scf/b) | 30 | 25 | 120 | 118 |

The data in Table 5 indicate that even though the zeolite content of the mixture of the Example 3 catalyst and Catapal alumina is lower than the zeolite content of the Example 2 catalyst, the conversion and gasoline production for both nitrogen-containing feedstocks tested increased. In the case of the feedstock containing 0.48 weight percent nitrogen, the conversion increased from 82 to 84 volume percent while the gasoline production increased from 56.8 to 58.8 volume percent. For the feedstock containing 0.74 weight percent nitrogen, the conversion increased from 75 to 78 volume percent and the gasoline production from 53.1 to 54.6 volume percent. It is believed that the Catapal alumina is an effective nitrogen scavenger because it preferentially sorbs nitrogen compounds and thereby prevents these compounds from neutralizing the acid sites in the zeolite of the catalyst. Furthermore, a comparison of data in Tables 4 and 5 shows that the increase in coke yield is smaller for the catalysts compared in Table 5 than for those compared in Table 4.

It will be apparent from the foregoing that the invention provides a process for the catalytic cracking of nitrogen contaminated feedstocks in which the cracking catalyst maintains a relatively high activity and selectivity for gasoline. The nitrogen tolerance of the catalyst results in longer run times between catalyst changeovers and the need for less makeup catalyst. Also, since a portion of the cracking catalyst is replaced with a less expensive nitrogen scavenger, the total catalysts cost are reduced. These factors in turn result in lower cost operations.

Although this invention has been primarily described in conjunction with examples and by reference to embodiments thereof, it is evident that many alternatives, modifications and variations will be apparent to those skilled in the art in light of the foregoing description. Accordingly, it is intended to embrace within the invention all such alternatives, modifications and variations that fall within the spirit and scope of the appended claims.

I claim:

1. A process for the catalytic cracking of a nitrogen-containing hydrocarbon feedstock which comprises contacting said feedstock in the vapor phase, without first treating said feedstock to remove at least a portion of said nitrogen compounds, with a mixture of a regenerated cracking catalyst and separate particles of a nitrogen scavenger under cracking conditions in the substantial absence of added molecular hydrogen in a cracking zone to convert components of said feedstock into lower molecular weight constituents, wherein said regenerated cracking catalyst comprises a molecular sieve having cracking activity dispersed in a matrix and said separate particles of said nitrogen scavenger comprise a mineral acid or a mineral acid precursor supported on an inorganic refractory oxide component.

2. A process as defined by claim 1 wherein said nitrogen scavenger comprises a mineral acid selected from the group consisting of phosphoric acid, sulfuric acid, and boric acid supported on said inorganic refractory oxide component.

3. A process as defined by claim 2 wherein said inorganic refractory oxide component is selected from the group consisting of alumina and clay.

4. A process as defined by claim 3 wherein said mineral acid comprises phosphoric acid and said inorganic refractory oxide component comprises alumina.

5. A process as defined by claim 1 wherein said nitrogen scavenger comprises a mineral acid precursor supported on said inorganic refractory oxide component.

6. A process as defined by claim 5 wherein said inorganic refractory oxide component is selected from the group consisting of alumina and clay.

7. A process as defined by claim 6 wherein said mineral acid precursor comprises a phosphoric acid precursor.

8. A process as defined by claim 7 wherein said phosphoric acid precursor comprises diammonium phosphate or monoammonium phosphate.

9. A process as defined by claim 1 wherein said nitrogen-containing hydrocarbon feedstock contains greater than about 0.08 weight percent total nitrogen, calculated as the element.

10. A process as defined by claim 1 wherein said nitrogen scavenger consists essentially of a mineral acid or a mineral acid precursor supported on an inorganic refractory oxide component.

11. A process for the catalytic cracking of a nitrogen-containing hydrocarbon feedstock which comprises contacting said feedstock in the vapor phase, without first treating said feedstock to remove at least a portion of said nitrogen compounds, with a mixture of a regenerated cracking catalyst and separate particles of a nitrogen scavenger under cracking conditions in the substantial absence of added molecular hydrogen in a cracking zone to convert components of said feedstock into lower molecular weight constituents, wherein said regenerated cracking catalyst comprises a molecular sieve having cracking activity dispersed in a matrix and said separate particles of said nitrogen scavenger comprise phosphoric acid or a phosphoric acid precursor supported on an inorganic refractory oxide component.

12. A process as defined by claim 11 wherein said nitrogen-containing hydrocarbon feedstock contains greater than about 0.08 weight percent total nitrogen.

13. A process as defined by claim 12 wherein said inorganic refractory oxide component is selected from the group consisting of alumina and clay.

14. A process as defined by claim 13 wherein said nitrogen scavenger comprises phosphoric acid supported on said inorganic refractory oxide component.

15. A process as defined by claim 13 wherein said nitrogen scavenger comprises a phosphoric acid precursor supported on said inorganic refractory oxide component.

16. A process as defined by claim 14 wherein said inorganic refractory oxide component comprises alumina.

17. A process as defined by claim 14 wherein said inorganic refractory oxide component comprises a clay.

18. A process as defined by claim 15 wherein said phosphoric acid precursor comprises diammonium phosphate or monoammonium phosphate.

19. A process as defined by claim 14 wherein said hydrocarbon feedstock contains between about 0.10 and about 0.50 weight percent total nitrogen, calculated as the element.

20. A process as defined by claim 11 wherein said nitrogen scavenger consists essentially of phosphoric acid or a phosphoric acid precursor supported on an inorganic refractory oxide component.

21. A process as defined by claim 16 wherein said nitrogen scavenger consists essentially of phosphoric acid supported on alumina.

22. A process as defined by claim 17 wherein said nitrogen scavenger consists essentially of phosphoric acid supported on a clay.

23. A process for the catalytic cracking of a hydrocarbon feedstock containing nitrogen compounds in an amount such that said feedstock contains greater than about 0.08 weight percent total nitrogen, calculated as the element, which process comprises contacting said feedstock in the vapor phase, without first treating said feedstock to remove at least a portion of said nitrogen compounds, with a mixture of a regenerated cracking catalyst and separate particles of a nitrogen scavenger under cracking conditions in the substantial absence of added molecular hydrogen in a cracking zone to convert components of said feedstock into lower molecular weight constituents, wherein said regenerated cracking catalyst comprises a molecular sieve having cracking activity dispersed in a matrix and said separate particles of said nitrogen scavenger comprise an acid clay.

24. A process as defined by claim 23 wherein said nitrogen scavenger comprises substantially no molecular sieve.

25. A process as defined by claim 23 wherein said nitrogen scavenger consists essentially of an acid clay.

26. A process as defined by claim 24 wherein said acid clay is selected from the group consisting of kaolin, halloysite, montmorillonite, hectorite, beidellite, vermiculite, nontronite, and saponite.

27. A process as defined by claim 26 wherein said acid clay comprises kaolin.

28. A process for the catalytic cracking of a hydrocarbon feedstock containing nitrogen compounds in an amount such that said feedstock contains greater than about 0.08 weight percent total nitrogen, calculated as the element, which process comprises contacting said feedstock in the vapor phase, without first treating said feedstock to remove at least a portion of said nitrogen compounds, with a mixture of a regenerated cracking catalyst and separate particles of a nitrogen scavenger under cracking conditions in the substantial absence of added molecular hydrogen in a cracking zone to convert components of said feedstock into lower molecular weight constituents, wherein said regenerated cracking catalyst comprises a molecular sieve having cracking activity dispersed in a matrix and said separate particles of said nitrogen scavenger comprise Catapal alumina, and wherein the concentration of metals in said hydrocarbon feedstock is such that the following relationship exists $$10[Ni]+[V]+[Fe] \text{ is less than about } 8.0$$

where [Ni], [V] and [Fe] are the concentrations of nickel, vanadium and iron, respectively, in parts per million by weight.

29. A process as defined by claim 28 wherein said nitrogen scavenger comprises substantially no molecular sieve.

30. A process as defined by claim 28 wherein said nitrogen scavenger consists essentially of Catapal alumina.

31. A process for the catalytic cracking of a hydrocarbon feedstock containing nitrogen compounds in an amount such that said feedstock contains greater than about 0.08 weight percent total nitrogen, calculated as the element, which process comprises contacting said feedstock in the vapor phase, without first treating said feedstock to remove at least a portion of said nitrogen compounds, with a mixture of a regenerated cracking catalyst and separate particles of a nitrogen scavenger under cracking conditions in the substantial absence of added molecular hydrogen in a cracking zone to convert components of said feedstock into lower molecular weight constituents, wherein said regenerated cracking catalyst comprises a zeolite having cracking activity and a pore size of about 8.1 Angstroms dispersed in a matrix and said separate particles of said nitrogen scavenger comprise a zeolite selected from the group consisting of hydrogen or ammonium exchanged mordenite, clinoptilolite, chabazite and erionite, and wherein the concentration of metals in said hydrocarbon feedstock is such that the following relationship exists $$10[Ni]+[V]+[Fe] \text{ is less than about } 8.0$$

where [Ni], [V] and [Fe] are the concentrations of nickel, vanadium and iron, respectively, in parts per million by weight.

32. A process as defined by claim 31 wherein said nitrogen scavenger comprises substantially no zeolite having a pore size of about 8.1 Angstroms.

33. A process as defined by claim 31 wherein said cracking catalyst consists essentially of a zeolite having cracking activity and a pore size of about 8.1 Angstroms dispersed in said matrix.

* * * * *